US007931166B2

(12) United States Patent
Cuocolo, Jr.

(10) Patent No.: US 7,931,166 B2
(45) Date of Patent: Apr. 26, 2011

(54) CONTAINER CAP

(76) Inventor: Joseph M. Cuocolo, Jr., Wilmington, DE (US)

( * ) Notice: Subject to any disclaimer, the term of this patent is extended or adjusted under 35 U.S.C. 154(b) by 843 days.

(21) Appl. No.: 11/854,368

(22) Filed: Sep. 12, 2007

(65) Prior Publication Data

US 2009/0065464 A1 Mar. 12, 2009

(51) Int. Cl.

| | |
|---|---|
| ***B65D 51/18*** | (2006.01) |
| ***A47G 19/22*** | (2006.01) |
| *A47G 21/18* | (2006.01) |

(52) U.S. Cl. ..... 220/254.2; 220/254.3; 220/254.9; 220/714; 220/717

(58) Field of Classification Search ..... 220/254.2, 220/254.3, 705, 714, 717
See application file for complete search history.

(56) References Cited

U.S. PATENT DOCUMENTS

| | | | | |
|---|---|---|---|---|
| 5,244,113 | A * | 9/1993 | Stymiest | 220/710.5 |
| 5,415,312 | A | 5/1995 | Mueller | |
| 5,651,471 | A | 7/1997 | Green | |
| 6,264,166 | B1 * | 7/2001 | Bowland et al. | 251/144 |
| 6,877,626 | B2 | 4/2005 | Sherrod | |
| 7,021,481 | B2 | 4/2006 | St. Germain et al. | |
| 7,059,490 | B2 * | 6/2006 | Son | 220/254.3 |
| 7,124,907 | B2 * | 10/2006 | Conaway | 220/254.1 |
| 2002/0179604 | A1 * | 12/2002 | Germain et al. | 220/254.2 |
| 2003/0052126 | A1 * | 3/2003 | Zettle et al. | 220/254.3 |
| 2004/0226950 | A1 * | 11/2004 | Samz et al. | 220/254.2 |
| 2005/0040169 | A1 * | 2/2005 | Son | 220/254.3 |
| 2005/0115967 | A1 * | 6/2005 | Conaway | 220/254.1 |
| 2005/0133519 | A1 * | 6/2005 | McDonough | 220/705 |
| 2006/0226110 | A1 * | 10/2006 | Choi et al. | 215/228 |
| 2006/0261068 | A1 * | 11/2006 | Schmidtner et al. | 220/254.9 |
| 2007/0170192 | A1 * | 7/2007 | Blum et al. | 220/826 |

* cited by examiner

*Primary Examiner* — Anthony Stashick
*Assistant Examiner* — Niki M Eloshway
(74) *Attorney, Agent, or Firm* — Dale J. Ream

(57) ABSTRACT

A cap device for use with a container or bottle includes adjacent first and second portions, each portion including a structure different than the other for accessing the contents of a container. The first portion may include an opening, such as a straw opening or pour opening, and a cover pivotally movable between open and closed configurations. The second portion may define a trough and include a drinking implement, such as a sipper, that is pivotal between retracted and extended configurations. The drinking implement includes first and second sections, the first section being rotatable between retractable and locked configurations. Contents of the container may be accessed when the second section is in the locked configuration. The drinking implement may be moved to the retracted configuration only when the second section is in its retractable configuration.

17 Claims, 7 Drawing Sheets

CONTAINER CAP

BACKGROUND OF THE INVENTION

This invention relates generally to beverage containers and dispensing lids and, more particularly, to a cap device for use with a container, such as a beverage container, that includes first and second adjacent portions each having a structure different than the other.

Young children often use what is commonly referred to as a sipper or "sippy" cup to drink milk, juice, or water. This type of cup typically includes a traditional container with a lid having a spout and which generally reduces spills. A disadvantage of a sipper container, however, is that the contents of a larger container, such as a milk or juice jug, must first be deposited into the sipper container and a lid must be attached thereto before the child may access those contents through the sipper spout. This is especially inconvenient when traveling and the milk or juice is obtained from a relatively small bottle that does not have its own sipper lid. Therefore, it would be desirable to have a cap device that could be attached directly to a bottle or other beverage container such that the contents of the container need not first be deposited into a traditional sipper container. While such a cap device may be attached directly to bottles at the point of manufacture, it may also be desirable for consumers to have such a cap device independent of any bottle, so as to attach it to a purchased bottle, such as a bottle of juice, as needed such as when traveling. Older children and adults frequently desire to access beverages through a straw or flip up lid. A "sports bottle" is an example of a convenient means by which individuals conveniently carry and access beverages.

Therefore, it would be desirable to have a container cap having adjacent lid portions each having a different structure for providing access to the contents of the container or bottle. Further, it would be desirable to have a container cap having both a sipper spout and defining a straw opening so that a toddler, an adult, or an older child may conveniently and selectively access the same beverage container. In addition, it would be desirable to have a container cap with multiple access structures that may be screwed onto existing beverage bottles.

SUMMARY OF THE INVENTION

Accordingly, a cap device for use with a beverage container according to the present invention includes a first portion defining an opening for providing access to contents of the container and a cover movable between a closed configuration covering the opening and an open configuration exposing the opening. This first portion may include a straw opening or a larger opening for pouring liquid out of the container. Further, the cap device includes a second portion adjacent the first portion having a trough that defines an access hole. A drinking implement, such as a sipper, may be coupled to the trough that is pivotal between a retracted configuration and an extended configuration. The drinking implement includes open first and second ends and defines a drinking channel therebetween. The drinking implement covers and closes the access hole by abutment when at the retracted configuration. The open second end of the drinking implement is adjacent said access hole when at said extended configuration so that the contents of the container may pass through the access hole, open second end, channel, and open first end. The first and second portions of the cap device may be removably coupled to the container, such as in a threaded arrangement.

In another embodiment, the cap device may include a combination of both a larger pour opening and straw opening.

Therefore, a general object of this invention is to provide a cap device for selectively accessing the contents of a container.

Another object of this invention is to provide a cap device, as aforesaid, that includes first and second portions, each having a structure different than the other for accessing the contents of the container.

Still another object of this invention is to provide a cap device, as aforesaid, having a sipper that enables a young child to drink from the container, the sipper being movable between retracted and extended configurations.

Yet another object of this invention is to provide a cap device, as aforesaid, having a straw opening or pour opening that enables a user to more conveniently access the contents of the container, the straw or larger opening being selectively covered when not in use.

A further object of this invention is to provide a cap device, as aforesaid, that enables a child or an adult to access the same beverage container through age appropriate access structures.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
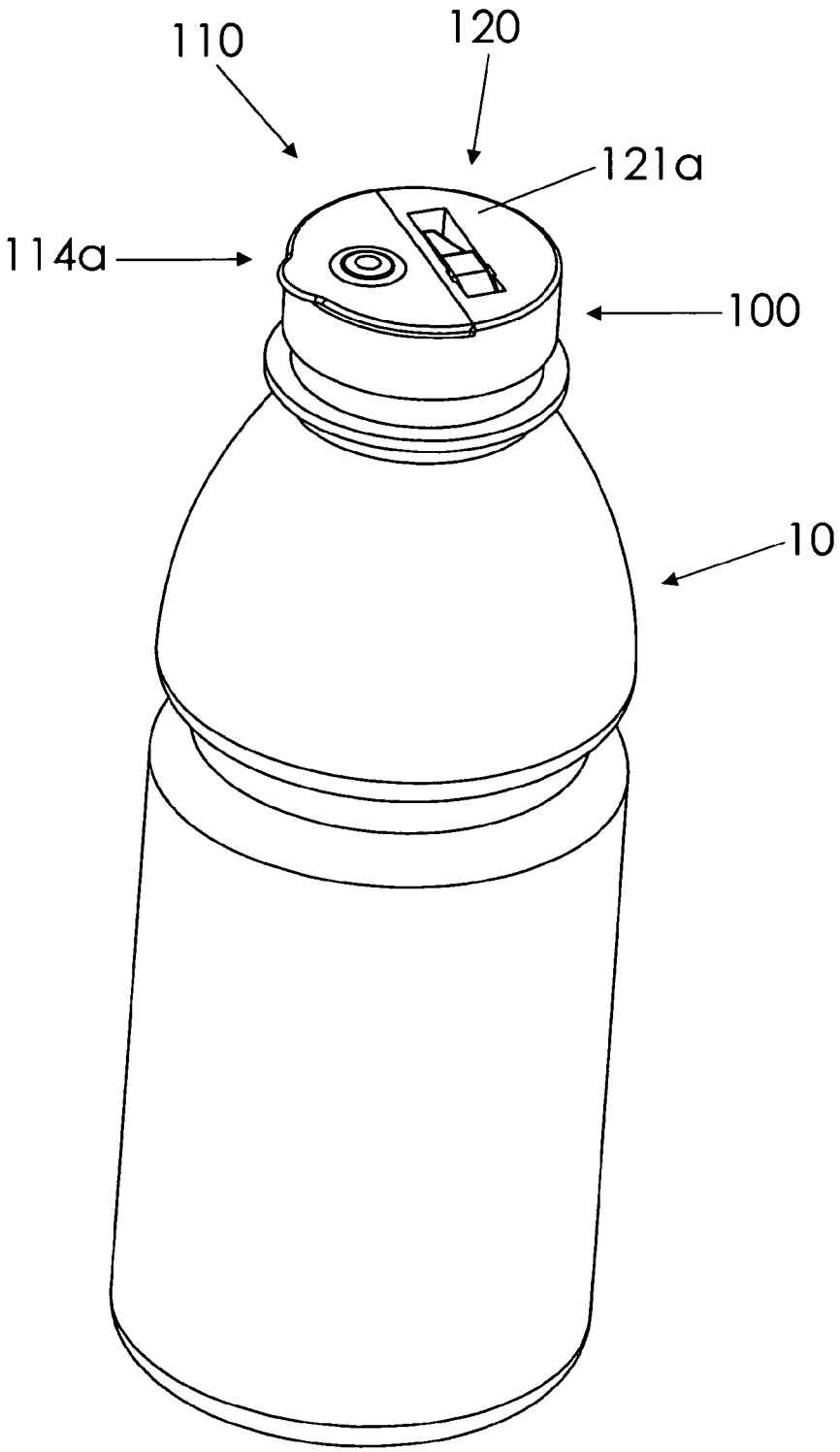
FIG. 1 is a perspective view of a cap device in use with a beverage container according to one embodiment of the present invention.

A container cap 100 according to the present invention will now be described in detail with reference to FIGS. 1 through 11 of the accompanying drawings. More particularly, according to the current invention, a cap device 100 for use with a container 10 includes first and second portions 110, 120 and means for coupling the first and second portions 110, 120 to the container 10. The first and second portions 110, 120 are adjacent one another. "Container" is used herein to refer to any beverage container (i.e., a cup, bottle, jar, or any other appropriate container).

The means for coupling the first and second portions 110, 120 to the container 10 may include, for example, at least one thread 130 having a configuration complementary to a thread of the container 10 (FIG. 3), a snap-fit configuration, and/or any other appropriate fastener.

Each portion 110, 120 includes means for selectively accessing contents of the container 10. The means of the first portion 110 for selectively accessing the container contents are different from the means of the second portion 120 for selectively accessing the container contents.

Figure 2:
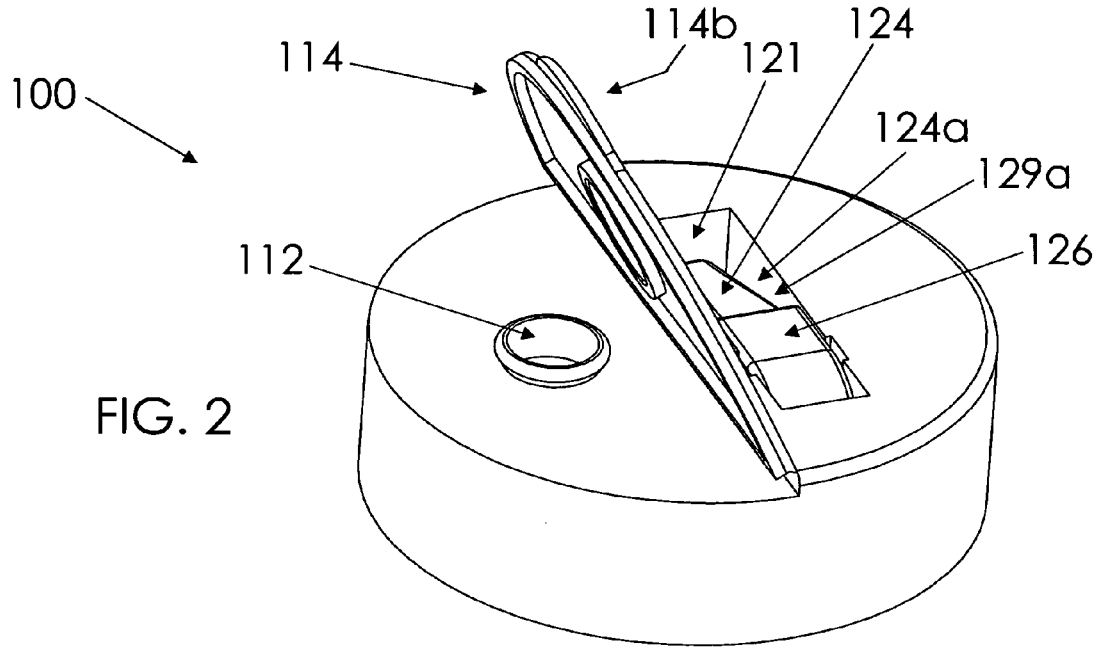
FIG. 2 is a perspective view of the cap device as in FIG. 1 removed from the container and showing a drinking implement in a retracted configuration.
Figure 9A:
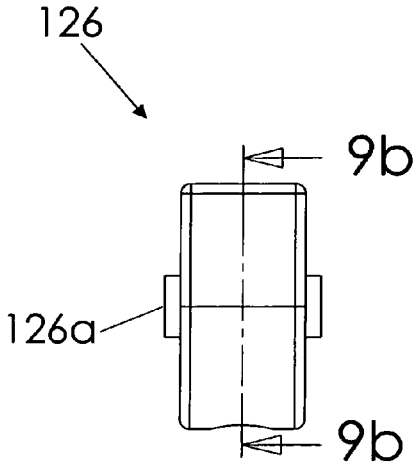
FIG. 9*a* is a side view of a first section of the drinking implement as in FIG. 6.
Figure 9B:
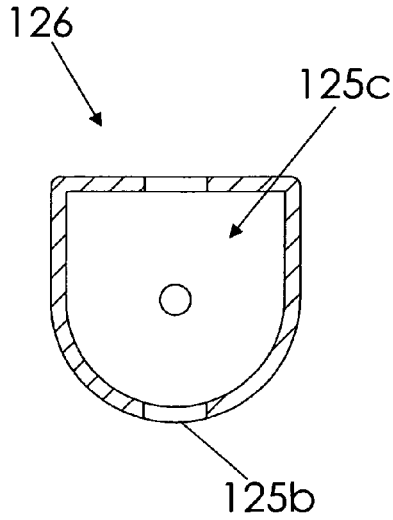
FIG. 9*b* is a sectional view taken along line 9*b*-9*b* of FIG. 9*a;*
Figure 10:
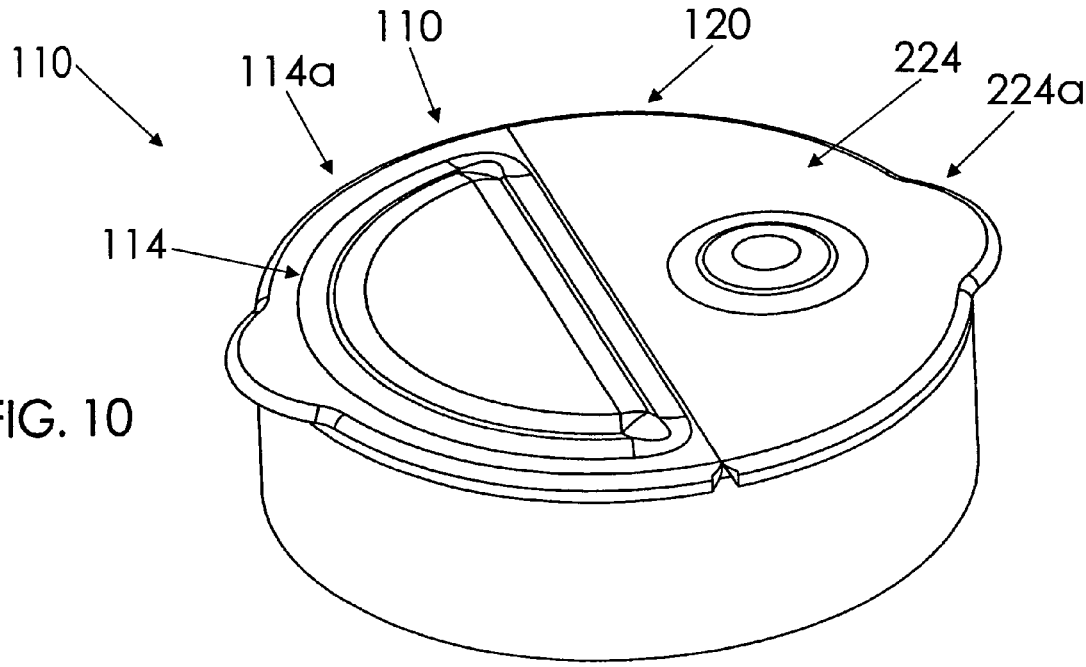
FIG. 10 is a perspective view of a cap device according to another embodiment of the present invention with respective covers in closed configurations.
Figure 11:
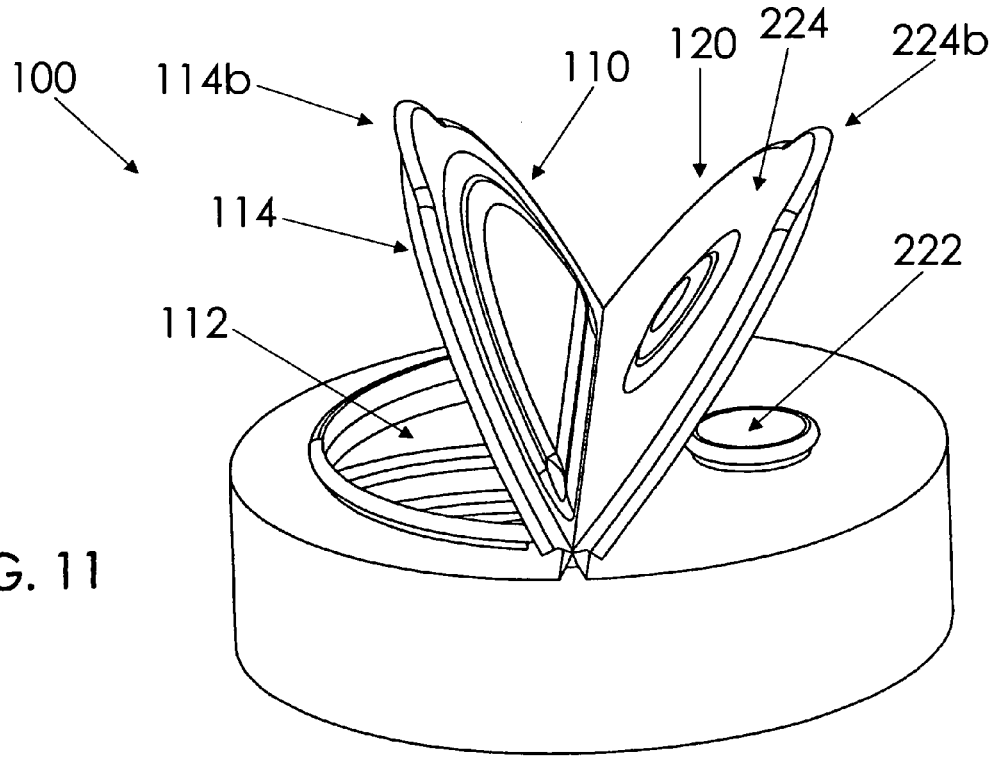
FIG. 11 is a perspective view of the cap device as in FIG. 10 with respective covers in open configurations.

As shown in FIGS. 2 through 11, the first portion means may include an opening 112 defined in the first portion 110 for providing access to contents of the container 10 and a cover 114 that is pivotal between a closed configuration 114*a* and an open configuration 114*b*. When at the closed configuration 114*a* (FIGS. 4 through 7*a* and FIG. 10), the cover 114 covers the opening 112; when at the open configuration 114*b* (FIGS. 2, 3, and 11), the cover 114 exposes the opening 112. The opening 112 may include a straw opening 112, as shown in FIG. 2, or a pour opening 112, as shown in FIG. 11. A "straw opening" is an opening that is sized to receive a straw or otherwise restrict an outpouring of contents from the container 10, while a "pour opening" is an opening that is relatively larger and unrestricted.

In one embodiment, shown in FIGS. 2 through 9*b*, the second portion means may include an access hole 122 defined by the second portion 120 and a retractable drinking implement 124. The drinking implement 124 is a structure that allows contents of the container 10 to be selectively directed out of the container 10, such as sipper. The drinking implement 124 may be rotatable between a retracted configuration 124*a* (FIG. 2) and an extended configuration 124*b* (FIGS. 4 and 5), and the drinking implement 124 may have open first and second ends 125*a*, 125*b* and define a drinking channel 125*c* therebetween (FIGS. 8*b* and 9*b*). The drinking implement 124 may close the access hole 122 (i.e., by abutment) when at the retracted configuration 124*a*, and the open second end 125*b* may be adjacent the access hole 122 when at the extended configuration 124*b* to allow contents of the container 10 to pass through the access hole 122, the open second end 125*b*, the channel 125*c*, and the open first end 125*a*.

Figure 4:
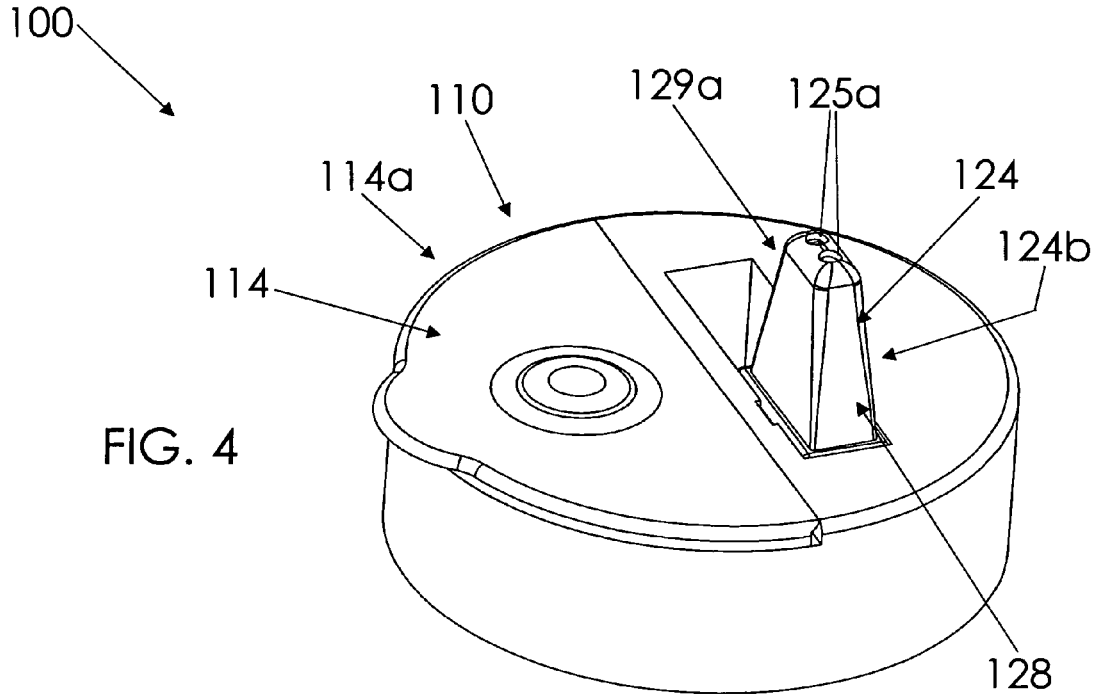
FIG. 4 is a perspective view of the cap device as in FIG. 2 with the drinking implement in an extended configuration.
Figure 5:
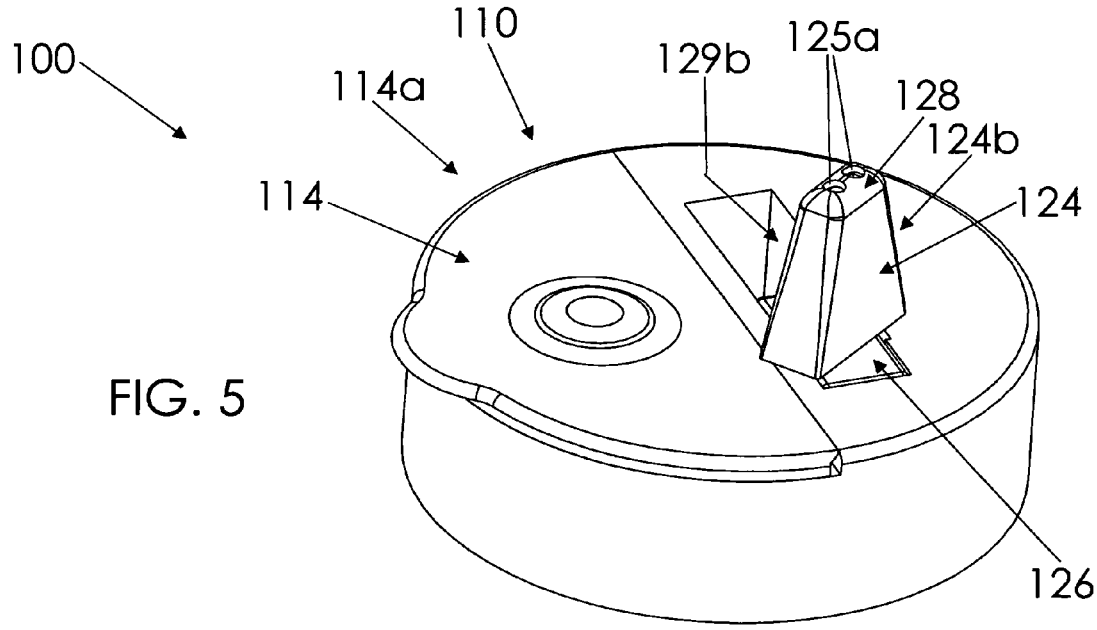
FIG. 5 is a perspective view of the cap device as in FIG. 4 with a second section of the drinking implement in a locked configuration.
Figure 6:
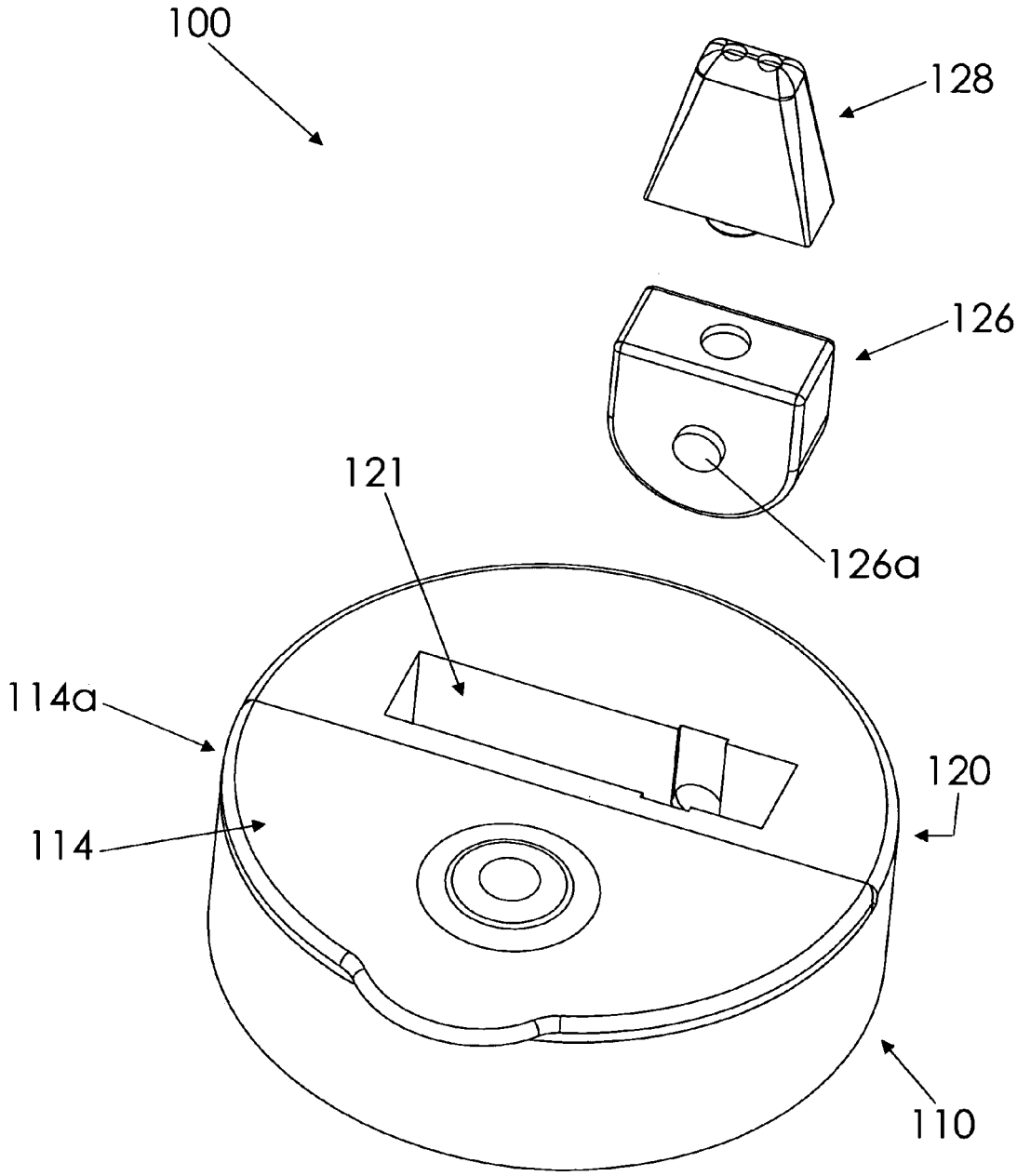
FIG. 6 is an exploded view of the cap device as in FIG. 4.

As shown in FIGS. 4 through 6 and FIGS. 8*a* through 9*b*, the drinking implement 124 may include first and second sections 126, 128. The first section 126 is pivotal (i.e., about pivot 126*a*) to move the drinking implement 124 between the retracted and extended configurations 124*a*, 124*b*, and the second section 128 is rotatable relative to the first section 126 (i.e., about pivot 128*a*) to move between a retractable configuration 129*a* (FIGS. 2 and 4) and a locking configuration 129*b* (FIG. 5). The configuration of the second section 128 may make the drinking implement 124 movable to the retracted configuration 124*a* only when the second section 128 is at the retractable configuration 129*a*, as shown in FIGS. 2 and 4, and the second section 128 may lock the first portion cover 114 at the closed configuration 114*a* (i.e., by abutment) when at the locking configuration 129*b*, as shown in FIG. 5. It is understood, however, that the second section 128 need not lock the first portion cover 114 if the first portion cover 114 were to, alternatively, not include a configuration that resulted in it being in abutment with the second section 128, for example if the cover 114 was less than a full hemispherical configuration.

The second portion 120 may have a trough 121 defining the access hole 122, and the drinking implement 124 may be coupled to the trough 121, as shown in FIGS. 2 through 7*b*. The trough 121 may allow the second portion 120 and the first portion cover 114 to collectively define a generally planar surface 121*a* when the cover 114 is at the closed configuration 114*a*. Such a generally planar surface 121*a* may be visually pleasing and/or functionally useful (e.g., for storage, shipment, ease of use, etc.). Such a trough 121 and/or planar surface 121*a* may not be required to utilize the cap device 100, however. It should also be understood that rotation of the second section 128 of the drinking implement 124 is to center it relative to a peripheral edge of the second portion 120 for more convenient use by a user desiring to drink therefrom (FIG. 5).

Figure 3:
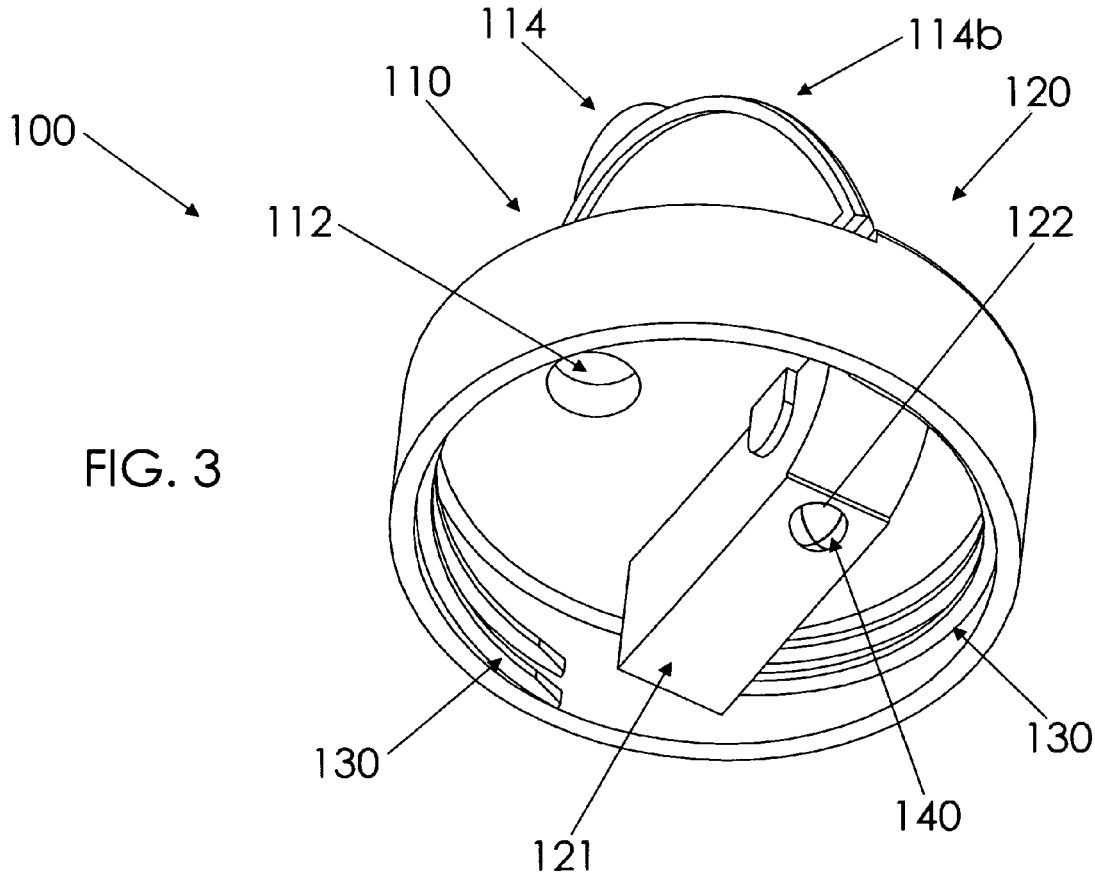
FIG. 3 is another perspective view of the cap device as in FIG. 1.
Figure 7A:
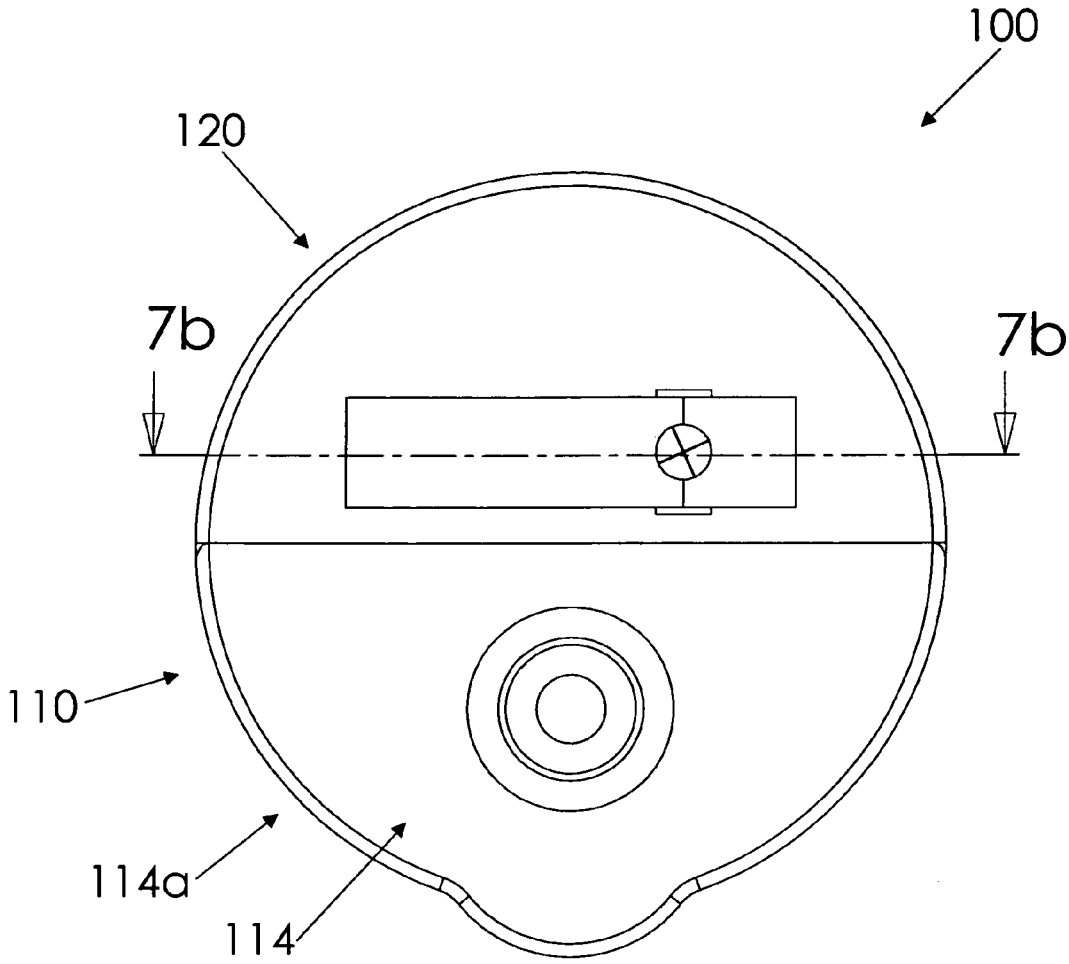
FIG. 7*a* is a top view of the cap device as in FIG. 2.
Figure 7B:
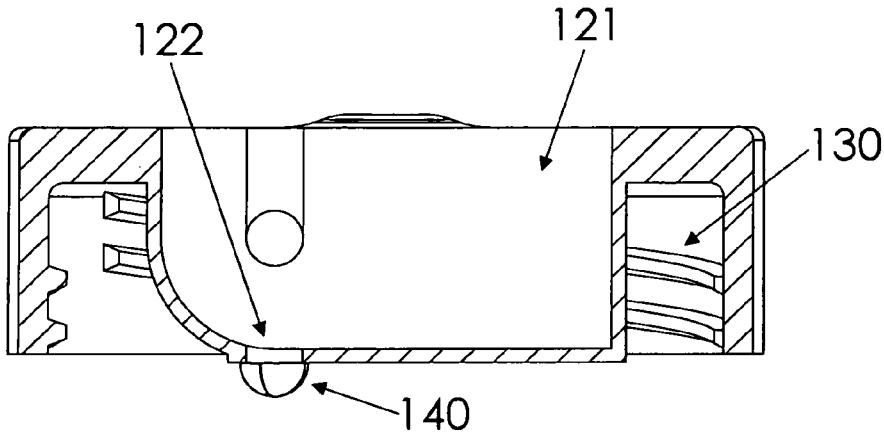
FIG. 7*b* is a sectional view of the cap device taken along line 7*b*-7*b* of FIG. 7*a;*
Figure 8A:
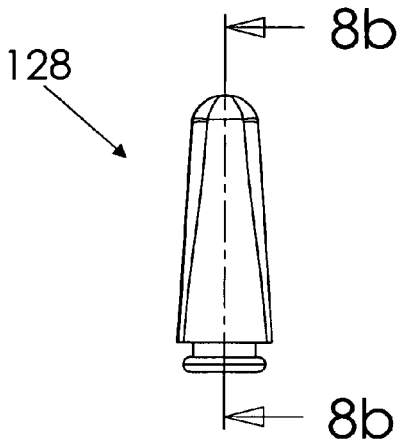
FIG. 8*a* is a side view of a second section of the drinking element as in FIG. 6.
Figure 8B:
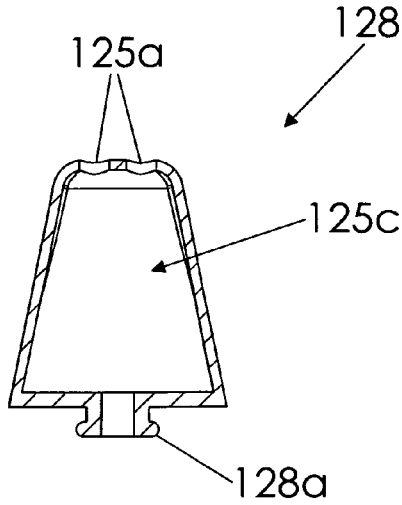
FIG. 8*b* is a sectional view taken along line 8*b*-8*b* of FIG. 8*a;*

A valve 140, as shown in FIGS. 3 and 7*b*, or an internal straw extending inside the container 10 (not shown) may be coupled to the access hole 122 to vary the functionality of the drinking implement 124. If the valve 140 is included, for example, the drinking implement 124 may act as a sipper implement (i.e., a spill-proof outlet), such as for use by children or in travel situations. If the straw is included, for example, the drinking implement 124 may pass the container's contents from the container 10 without tipping the container 10 if the user sucks from the drinking implement 124; in other words, the drinking implement 124 may be used as a typical straw.

In another embodiment, shown in FIGS. 10 and 11, the second portion means may include an opening 222 in the second portion 120 for providing access to contents of the container 10, and a cover 224 that is rotatable between a closed configuration 224*a* and an open configuration 224*b*. When at the closed configuration 224*a* (FIG. 10), the cover 224 covers the opening 222; when at the open configuration 224*b* (FIG. 11), the cover 224 exposes the opening 222. The opening 222 may be a straw opening 222 or a pour opening 112, as shown in FIG. 11.

In use, the first and second portions 110, 120 may be coupled to the container or container 10 (e.g., by thread 130), as shown in FIG. 1. The cover 114 of the first portion 110 may be moved from the closed configuration 114*a* to the open configuration 114*b*, and the user may access the contents of the container 10 through the opening 112 when the cover 114 is at the open configuration 114*b*.

If the second portion 120 includes the access hole 122 and the drinking implement 124, the drinking implement 124 may be rotated (i.e., about pivot 126*a*) from the retracted configuration 124*a* to the extended configuration 124*b*. The second section 128 may be rotated relative to the first section 126 (i.e., about pivot 128*a*) from the retractable configuration 129*a* (FIGS. 2 and 4) to the locking configuration 129*b* (FIG. 5), and when at the locking configuration 129*b*, the second section 128 may lock the cover 114 closed by abutment. This may keep the contents of the container 10 from spilling out the first portion opening 112 inadvertently. The drinking implement 124 may be used as described above to access the contents of the container 10 when at the extended configuration 124*b*.

If the second portion 120 includes the opening 222, the cover 224 may be moved from the closed configuration 224*a* to the open configuration 224*b*, and the user may access the contents of the container 10 through the opening 222 when the cover 224 is at the open configuration 224*b*. Because the opening 222 is different from the opening 112 as noted above, the user may decide to utilize opening 112 or opening 222 based on, for example, intended use.

It is understood that while certain forms of this invention have been illustrated and described, it is not limited thereto except insofar as such limitations are included in the following claims and allowable functional equivalents thereof.

The invention claimed is:

1. A cap device for use with a container, said device comprising:

a first portion having an opening for providing access to contents of said container and a cover movable between a closed configuration covering said opening and an open configuration exposing said opening;

a second portion adjacent said first portion; said second portion defining an access hole and a retractable drinking implement pivotal between a retracted configuration and an extended configuration; said drinking implement defining a drinking channel having open first and second ends; said drinking implement covering said access hole when at said retracted configuration; said drinking implement open second end being adjacent said access hole when at said extended configuration to allow contents of said container to pass through said access hole, said open second end, said channel, and said open first end;

means for coupling said first and second portions to said container;

wherein:

said drinking implement includes first and second sections;

said first section is pivotal to move said drinking implement between said retracted and extended configurations;

said second section is rotatable relative to said first section to move between a retractable configuration and a locking configuration;

said drinking implement is movable to said retracted configuration only when said second section is at said retractable configuration; and said second section locks said first portion cover at said closed configuration when at said locking configuration.

2. The cap device as in claim 1, wherein said first portion cover and said second portion collectively define a generally planar surface when said cover is at said closed configuration.

3. The cap device as in claim 2, wherein either a valve or an internal straw extending inside said container is coupled to said access hole.

4. The cap device as in claim 3, wherein said means for coupling said first and second portions to said container includes at least one thread having a configuration complementary to a thread of said container.

5. The cap device as in claim 1, wherein either a valve or an internal straw extending inside said container is coupled to said access hole.

6. The cap device as in claim 1, wherein said means for coupling said first and second portions to said container includes at least one thread having a configuration complementary to a thread of said container.

7. The cap device as in claim 1, wherein said first portion opening is either a straw opening or a pour opening.

8. A cap device for use with a container, said device comprising:

a first portion having an opening for providing access to contents of said container and a cover pivotal between a closed configuration covering said opening and an open configuration exposing said opening;

a second portion adjacent said first portion, said second portion having a trough defining an access hole;

a drinking implement coupled to said trough and being pivotal between a retracted configuration and an extended configuration; said drinking implement defining open first and second ends and defining a drinking channel therebetween; said drinking implement closing said access hole by abutment when at said retracted configuration; said drinking implement open second end being adjacent said access hole when at said extended configuration to allow contents of said container to pass through said access hole, said open second end, said channel, and said open first end;

means for coupling said first and second portions to said container; and wherein:

said drinking implement has first and second sections;

said first section is pivotal to move said drinking implement between said retracted and extended configurations;

said second section is rotatable relative to said first section to move between a retractable configuration and a locking configuration;

said drinking implement is movable to said retracted configuration only when said second section is at said retractable configuration; and said second section locks said first portion cover at said closed configuration by abutment when at said locking configuration.

9. The cap device as in claim 8, wherein said first portion cover and said second portion collectively define a generally planar surface when said cover is at said closed configuration.

10. The cap device as in claim 9, wherein either a valve or an internal straw extending inside said container is coupled to said access hole.

11. The cap device as in claim 10, wherein said means for coupling said first and second portions to said container includes at least one thread having a configuration complementary to a thread of said container.

12. The cap device as in claim 8, wherein either a valve or an internal straw extending inside said container is coupled to said access hole.

13. A cap device for use with a container, said device comprising:

a first portion having means for selectively accessing contents of said container;

a second portion having means for selectively accessing contents of said container, said first portion means being different from said second portion means; and means for coupling said first and second portions to said container;

wherein:

said first portion means defined a first opening that provides access to contents of said container and a cover movable between a closed configuration covering said first opening and an open configuration exposing said first opening;

said first opening is one of a straw opening or a pour opening;

said second portion means includes an access hole and a retractable drinking implement rotatable between a retracted configuration and an extended configuration; said drinking implement having open first and second ends and defining a drinking channel therebetween; said drinking implement closing said access hole by abutment when at said retracted configuration; said drinking implement open second end being adjacent said access hole when at said extended configuration to allow contents of said container to pass through said access hole, said open second end, said channel, and said open first end;

said drinking implement has first and second sections;

said first section is pivotal to move said drinking implement between said retracted and extended configurations;

said second section is rotatable relative to said first section to move between a retractable configuration and a locking configuration;

said drinking implement is movable to said retracted configuration only when said second section is at said retractable configuration; and said second section locks said first portion cover at said closed configuration when at said locking configuration.

14. The cap device as in claim 13, wherein:

said first portion means includes a straw opening for providing access to contents of said container and a cover movable between a closed configuration covering said straw opening and an open configuration exposing said straw opening;

said second portion means includes a pour opening for providing access to contents of said container and a cover movable between a closed configuration covering said pour opening and an open configuration exposing said pour opening.

15. The cap device as in claim 13, wherein:

said first portion means defines a first opening that provides access to contents of said container and a cover movable between a closed configuration covering said first opening and an open configuration exposing said first opening; and said first opening is one of a straw opening or a pour opening.

16. The cap device as in claim 15, wherein:

said second portion means includes a second opening for providing access to contents of said container and a cover movable between a closed configuration covering said second opening and an open configuration exposing said second opening; and said second opening is another of a straw opening or a pour opening.

17. The cap device as in claim 13, wherein said second portion means includes:

an access hole; and a retractable drinking implement rotatable between a retracted configuration and an extended configuration; said drinking implement having open first and second ends and defining a drinking channel therebetween; said drinking implement closing said access hole by abutment when at said retracted configuration;

said drinking implement open second end being adjacent said access hole when at said extended configuration to allow contents of said container to pass through said access hole, said open second end, said channel, and said open first end.

* * * * *